US011215193B2

(12) United States Patent
Berberoglu et al.

(10) Patent No.: US 11,215,193 B2
(45) Date of Patent: Jan. 4, 2022

(54) FAN ASSEMBLY WITH A SELF-ADJUSTING GAP AND ELECTRONIC DEVICES WITH A FAN ASSEMBLY

(71) Applicant: Apple Inc., Cupertino, CA (US)

(72) Inventors: Halil Berberoglu, Saratoga, CA (US); Cheng Ping Tan, Fremont, CA (US); Arash Naghib Lahouti, San Jose, CA (US); Richard A. Herms, Los Altos, CA (US); Jesse T. Dybenko, Santa Cruz, CA (US); Ashkan Rasouli, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 36 days.

(21) Appl. No.: 16/792,034

(22) Filed: Feb. 14, 2020

(65) Prior Publication Data

US 2021/0095692 A1 Apr. 1, 2021

Related U.S. Application Data

(60) Provisional application No. 62/906,653, filed on Sep. 26, 2019.

(51) Int. Cl.
*F04D 29/42* (2006.01)
*F04D 17/10* (2006.01)

(52) U.S. Cl.
CPC ..... *F04D 29/4226* (2013.01); *F04D 17/10* (2013.01)

(58) Field of Classification Search
CPC ..... F04D 17/10; F04D 17/16; F04D 29/422; F04D 29/4226; F04D 29/462; F05D 2250/52
See application file for complete search history.

(56) References Cited

U.S. PATENT DOCUMENTS 3,174,682 A * 3/1965 Wilfert ..... F04D 29/664 415/119
5,092,136 A * 3/1992 Kang ..... F25D 17/045 62/408
8,075,257 B2 * 12/2011 Tien ..... G06F 1/20 415/185
8,206,099 B2 6/2012 Tsai et al.
8,662,832 B2 * 3/2014 Tsai ..... F04D 29/4246 415/148

(Continued)

OTHER PUBLICATIONS

"One-click total system optimization!"; Z97-A, Motherboard, Asus, 42 pages. https://www.asus.com/us/Motherboards/Z97A/.

*Primary Examiner* — Ninh H. Nguyen
(74) *Attorney, Agent, or Firm* — Dickinson Wright RLLP

(57) ABSTRACT

An electronic device with a fan assembly is disclosed. The fan assembly includes an impeller and an insert separated from the impeller by a gap. The fan assembly increases airflow by rotationally driving the impeller. For a sufficient rotational speed of the impeller, the airflow reaches a level that provides a force that displaces the insert. The displacement may include movement and/or compression of the insert. As a result of the displacement, the gap between the impeller and the insert increases. The increased gap reduces the pressure and associated noise that is otherwise caused by the airflow. When the rotational speed of the impeller reduces or ceases, the insert returns to its initial position. In this manner, the fan assembly includes a self-adjusting gap that changes based on the airflow.

20 Claims, 16 Drawing Sheets

(56) References Cited

U.S. PATENT DOCUMENTS

| | | | | |
|---|---|---|---|---|
| 9,068,573 | B2 * | 6/2015 | Kuo | F04D 27/002 |
| 9,951,789 | B2 * | 4/2018 | Sawyer | F04D 29/4226 |
| 2010/0084123 | A1 | 4/2010 | Shishido et al. | |

* cited by examiner

FAN ASSEMBLY WITH A SELF-ADJUSTING GAP AND ELECTRONIC DEVICES WITH A FAN ASSEMBLY

CROSS-REFERENCE TO RELATED APPLICATION(S)

This application claims the benefit of priority to U.S. Provisional Application No. 62/906,653, filed on Sep. 26, 2019, titled "FAN ASSEMBLY WITH A SELF-ADJUSTING GAP AND ELECTRONIC DEVICES WITH A FAN ASSEMBLY," the disclosures of which are incorporated herein by reference in their entirety.

FIELD

The following description relates to fan assemblies in consumer electronic devices. In particular, the following description relates to a fan assembly that includes a self-adjusting throat gap designed to mitigate noise levels generated by the fan assembly during operation, as well as maintain an airflow threshold out of the fan assembly.

BACKGROUND

Electronic devices can use a fan to cool components that undergo temperature increase during operation. As some components (such as central processing units and graphics processing units) become more advanced, the components can undergo temperature increases that last longer and/or cause the components to run hotter. In order to mitigate these effects, the fan can run at higher speeds, thereby drawing more heated air away from the components.

However, running the fan at higher speeds has some drawbacks. For instance, noise generation is proportional to fan speed (measured in revolutions per minute). Accordingly, as the fan speed increases, the noise generation by the fan also increases. This can lead to a less desirable user experience. One solution for reducing noise levels is to increase the gap between the impeller blades of the fan and the housing walls that defines the fan scroll, thereby increasing the cross-sectional area through which the air flows and reducing air pressure. There are instances when a tonal blade passing noise becomes prominent only at elevated fan speeds. In these instances, it can be beneficial to increase the radial gap between impeller blades and housing walls to reduce this noise at high speeds. However, the increased radial gap will penalize transmitted airflow at lower fan speeds, where there was no tonal noise to mitigate.

SUMMARY

In one aspect, an electronic device is described. The electronic device may include an enclosure that defines an internal volume. The electronic device may further include a fan assembly located in the internal volume. The fan assembly may include a fan housing. The fan assembly may further include an impeller positioned in the fan housing. The fan assembly may further include an insert positioned in the fan housing and separated from the impeller by a gap. In some embodiments, airflow by the impeller into the gap causes displacement of the insert such that the gap changes from a first size to a second size that is greater than the first size.

In another aspect, an electronic device is described. The electronic device may include an enclosure that defines an internal volume. The electronic device may further include a fan assembly located in the internal volume. The fan assembly may include a fan housing. The fan assembly may include an impeller located in the fan housing. The fan assembly may further include an insert located in the fan housing. In some embodiments, a decompressed state of the insert may include a separation between the insert and the impeller by a gap having a first dimension. In some embodiments, a compressed state of the insert may include the separation between the insert and the impeller increasing to a second dimension of the gap that is greater than the first dimension.

In another aspect, a method for operating a fan assembly in an electronic device is described. The method may include rotating an impeller of the fan assembly. The method may further include driving airflow, by the impeller, through a fan housing having an insert separated from the impeller by a gap. The method may further include compressing the insert, based on the airflow, such that the gap transitions from a first size to a second size greater than the first size.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The disclosure will be readily understood by the following detailed description in conjunction with the accompanying drawings, wherein like reference numerals designate like structural elements, and in which.

Figure 1:
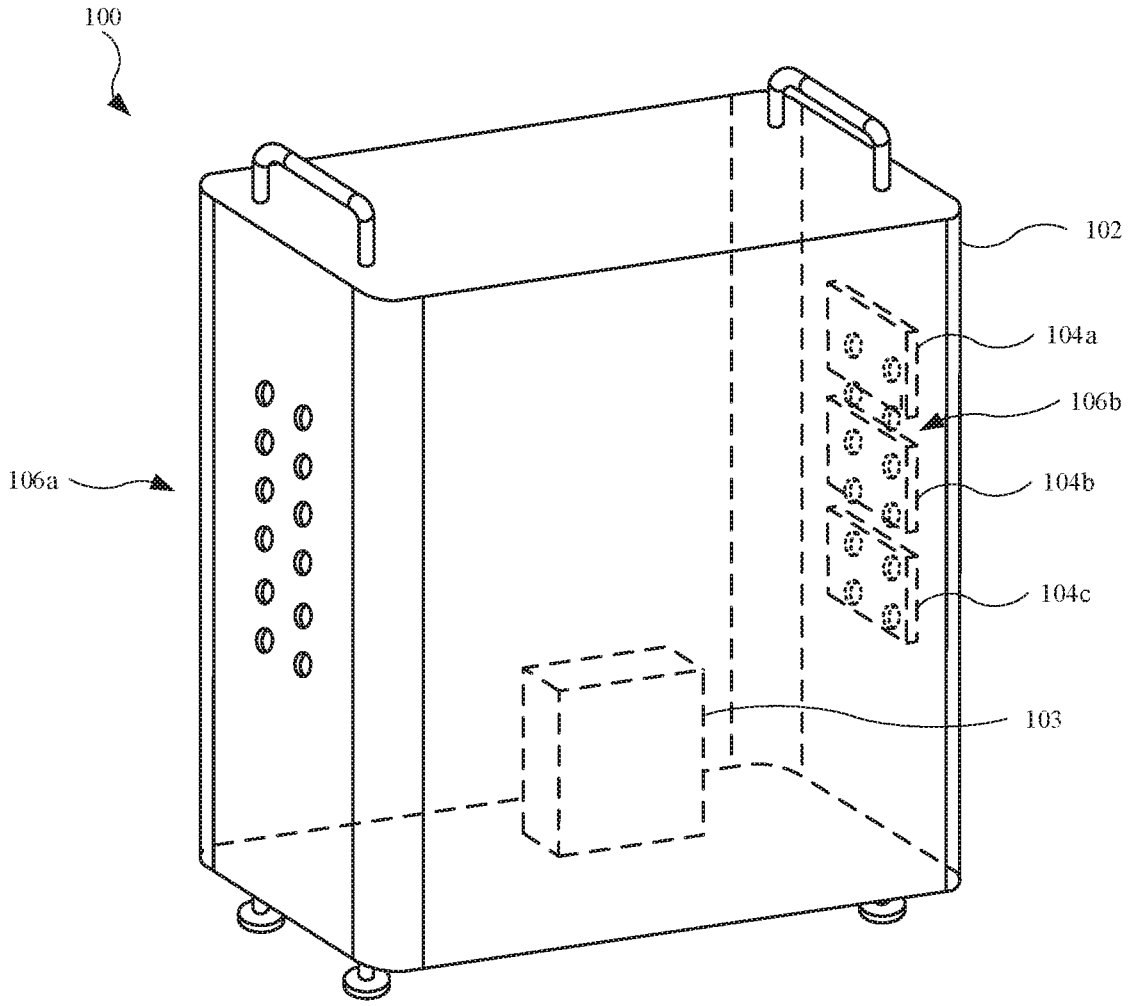
FIG. 1 illustrates an isometric view of an embodiment of an electronic device, in accordance with some described embodiments.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting such that other embodiments may be used, and changes may be made without departing from the spirit and scope of the described embodiments.

The following disclosure relates to fan assemblies in consumer electronic devices. A fan assembly described herein is modified to reduce noise levels while also providing a minimum airflow threshold. The gap is defined as a separation or space between an impeller and a fan scroll (defined by the fan housing). In particular, the location of interest of is the throat gap defined by a minimum separation between the impeller and the fan scroll. Generally, the fan assembly, including the fan housing, includes a rigid structure, such as plastic. However, the fan assembly is modified with an insert located at the throat gap. Using the insert, the fan assembly includes a self-adjusting throat gap that is regulated by pressure applied by the airflow into the fan assembly by the impeller. For example, when the impeller is rotationally driven at or above a threshold speed (measured in revolutions per minute, or RPM), the force provided by the airflow is sufficient to compress, or otherwise displace, the insert. As a result, the throat gap widens and the air pressure through the gap decreases, thereby mitigating the tonal component of the noise level the fan assembly.

In order to displace (e.g., deform or compress) the insert, the force of the airflow must overcome the compressive strength of the insert such that $$F_a > F_i \tag{1}$$

where $F_a$ is the force provided by the airflow and $F_i$ is the opposing force of the material of the insert. In order to move the insert a distance x, the impeller must achieve rotation speed such that $$F_a = kx \tag{2}$$

where k is the spring constant of the material of the insert. Accordingly, the displacement of the insert is proportional to the force provided by the airflow. Further, the size (cross sectional area) of the throat gap is proportional to the displacement of the insert, and accordingly, the gap size is proportional to the airflow provided by the impeller.

As the airflow increases, the air pressure at the gap also increases. The air pressure at the gap is a function of the cross sectional area of the gap, and can be approximated by $$P = \frac{F_a}{A_g} \tag{3}$$

where P is the air pressure at the gap (due to airflow) and $A_g$ is the area of the gap. Accordingly, the pressure is inversely proportional to the area of the gap. Thus, by allowing displacement of the insert, the gap can increase and relieve pressure at the gap. When the air pressure reduces, the noise level generated by the fan assembly is mitigated. While the fan assembly generates an overall broadband noise, the tonal component of the noise level generated by the fan assembly is mitigated, and the noise heard by a user is lower.

While it is beneficial to increase the throat gap size to reduce the tonal component, it is also beneficial for the fan assembly to drive airflow at lower fan speeds (in terms of RPM). In this regard, once the components begin to cool, the fan speed may lower. When the fan speed is sufficiently lowered, the air pressure reduces, the insert returns to its original position, and the throat gap returns to its original size. By reducing the throat gap size, additional airflow leaves the fan assembly rather than passing through the throat gap and remaining in the fan assembly. Accordingly, the insert may undergo an elastic deformation and is not permanently deformed from the airflow.

The insert may include a compliant material, such as foam or some membrane material. The foam may include open-cell foam or closed-cell foam. Alternatively, or in combination, the insert may include a spring-loaded material or a structure connected to the fan housing by a hinge. In any event, the insert is integrated into the fan assembly and calibrated to provide allow the highest flow rate as well as the lowest sound pressure and best sound quality.

These and other embodiments are discussed below with reference to FIGS. 1-19. However, those skilled in the art will readily appreciate that the detailed description given herein with respect to these Figures is for explanatory purposes only and should not be construed as limiting.

FIG. 1 illustrates an isometric view of an embodiment of an electronic device 100, in accordance with some described embodiments. As shown, the electronic device 100 may include a desktop, or "tower," computing device designed for use with a display and other accessories (not shown in FIG. 1), such as a display/monitor, a mouse, and/or a keyboard. The electronic device 100 includes an enclosure 102, or housing, that defines an internal volume that can carry several internal components including, as non-limiting examples, processing circuitry (such as a central processing unit and a graphics processing unit), memory circuits, circuit boards, an audio component (or components), a microphone (or microphones), a battery, and flexible circuitry that connects together the aforementioned components. As an example, the electronic device 100 includes a heat-generating component 103 (representative one or more heat-generating components) that undergoes a temperature increase and heat the surrounding air within the internal volume during operation of the electronic device 100. At least some of these components may generate heat during operation of the electronic device 100, thereby increase the temperate of the components.

The electronic device 100 may include one or more fan assemblies, such as a fan assembly 104*a*, a fan assembly 104*b*, and a fan assembly 104*c*. Each of the fan assemblies can draw the heated air away from heat-generating component 103. Further, each of the fan assemblies can receive ambient air via openings 106*a* formed in the enclosure 102, and subsequently drive the heated air out of the enclosure 102 via openings 106*b* formed in the enclosure 102. As a result, the fan assemblies can reduce the temperature of the components within the internal volume of the enclosure 102. In order to activate and deactivate the fan assemblies, the processing circuitry can provide a signal to turn on one or more of the fan assemblies and terminate the signal to turn off one or more of the fan assemblies. The input information provided to the processing circuitry may include one or more temperature sensors (not shown in FIG. 1) that determine(s) the temperature of the components within the internal volume of the enclosure 102. As a result, when a threshold temperature is reached or exceeded, the processing circuitry can provide the signal to turn on one or more of the fan assemblies. Alternatively, or in combination, the input information provided to the processing circuitry may include an amount of time the heat-generating component 103 is in use. For example, after 10 minutes of operation of the heat-generating component 103, the processing circuitry can provide the signal to turn on one or more of the fan assemblies. The time is intended to be exemplary only, and a different time (or times) may be used.

Figure 2:
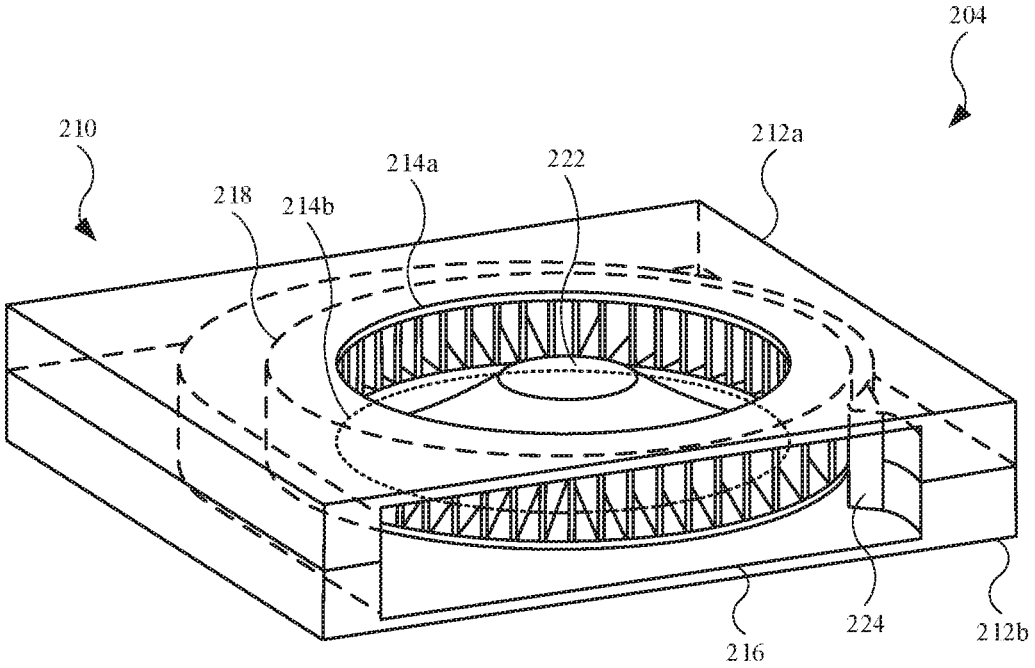
FIG. 2 illustrates an isometric view of an embodiment of a fan assembly for use in electronic devices, in accordance with some described embodiments.

FIG. 2 illustrates an isometric view of an embodiment of a fan assembly 204 for use in electronic devices, in accordance with some described embodiments. The fan assembly 104*a*, the fan assembly 104*b*, and the fan assembly 104*c* (all shown in FIG. 1) may include any features described herein for the fan assembly 204. As shown, the fan assembly 204 includes a fan housing 210. The fan housing 210 may include a housing part 212*a* and a housing part 212*b* that is coupled to the housing part 212*a*. The housing part 212*a* and the housing part 212*b* may be referred to as a first housing part and a second housing part, respectively. Also, while the fan housing 210 is shown as a two-piece structure, the number of pieces can vary.

The fan assembly 204 further includes a fan inlet 214*a* and a fan inlet 214*b*, each of which provides a pathway for air into the fan assembly 204. The fan inlet 214*a* and the fan inlet 214*b* may be referred to as a first fan inlet and a second fan inlet, respectively. As shown, the fan inlet 214*a* and the fan inlet 214*a* are formed in the housing part 212*a* and the housing part 212*b*, respectively. The fan assembly 204 further includes a fan outlet 216 that is defined by the housing part 212*a* and the housing part 212*b*. The fan inlet 214*a* and the fan inlet 214*b* may each include a circular fan inlet and the fan outlet 216 may include a rectangular fan outlet. However, other shapes are possible. The fan assembly 204 further includes an impeller 218. The impeller 218 may include several blades (not labeled) connected to an impeller hub 222. The number of blades of the impeller 218 may be approximately in the range of 25-100 blades. The fan assembly 204 further includes a motor (shown below) that is coupled to the impeller 218 via the impeller hub 222. During operation, the motor rotationally drives the impeller 218 (including the blades), which draws heated air away from heat-generating component 103 of the electronic device 100 (shown in FIG. 1) and into the fan housing 210 via the fan inlet 214*a* and the fan inlet 214*b*. The air received by the fan inlets passes through the fan housing 210 and out of the fan outlet 216. In this manner, the fan assembly 204 provides cooling features for the heat-generating component 103.

Also, the fan assembly 204 may include an insert 224 located in the fan housing 210. The insert 224 may include foam (open cell foam or closed cell foam) or an elastomeric material, as non-limiting examples. Generally, the insert 224 may include any material, or materials, designed to deform, or undergo some form of displacement, during operation of the fan assembly 204. In this regard, the insert 224 may be referred to as a deforming member, a deformable member, or a deformable membrane, as non-limiting examples. While the housing part 212*a* and the housing part 212*b* may include a rigid material (such as plastic or metal) designed to withstand any displacement from airflow from generated by the impeller 218, the insert 224 is designed undergo some form of displacement during operation of the impeller 218. This will be further shown and described below.

Figure 3:
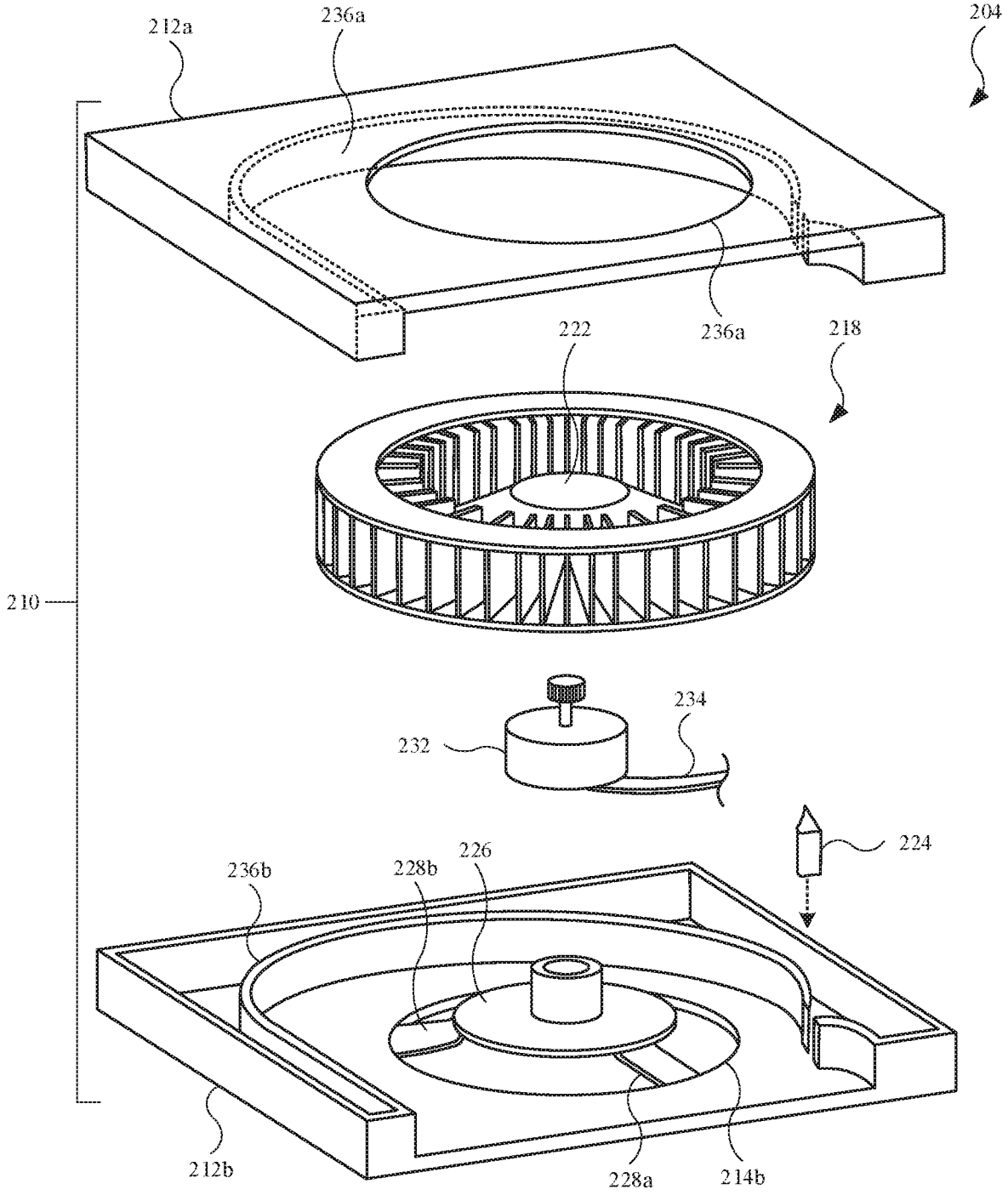
FIG. 3 illustrates an exploded view of the fan assembly shown in FIG. 2, showing various features of the fan assembly.

FIG. 3 illustrates an exploded view of the fan assembly 204 shown in FIG. 2, showing various features of the fan assembly 204. As shown, the housing part 212*b* includes a platform 226 connected by several structures, such as a strut 228*a* and a strut 228*b*. Although not shown, an additional strut may be present. The fan assembly 204 includes a motor 232 that can be positioned on the platform 226. The motor 232 can couple to the impeller hub 222 and rotationally drive the impeller 218. In order to provide power and control signals from processing circuitry of the electronic device 100 (shown in FIG. 1), the motor 232 includes a flexible circuit 234 that electrically connects to the processing circuitry. The flexible circuit 234 can be routed through the fan inlet 214*b*.

The housing part 212*a* and the housing part 212*b* of the fan housing 210 may each include an internal wall. For example, the housing part 212*a* and the housing part 212*b* include an internal wall 236*a* and an internal wall 236*b*, respectively. When the housing part 212*a* is coupled with the housing part 212*b*, the internal wall 236*a* and the internal wall 236*b* combine to define a fan scroll that collects and directs air taken in by the impeller 218 via the fan inlet 214*a* and the fan inlet 214*b*. Moreover, the internal wall 236*a* and the internal wall 236*b* are each modified such that the insert 224 is integrated and defines, in part, the fan scroll. As a result, the insert 224 is exposed to airflow driven the impeller 218 during operation.

FIGS. 4-7 show and describe exemplary motion of the insert 224 during operation of the fan assembly 204 (and in particular, during operation of the impeller 218). For purposes of illustration, the housing part 212*a* is removed from the fan assembly 204 in FIGS. 4-7.

Figure 4:
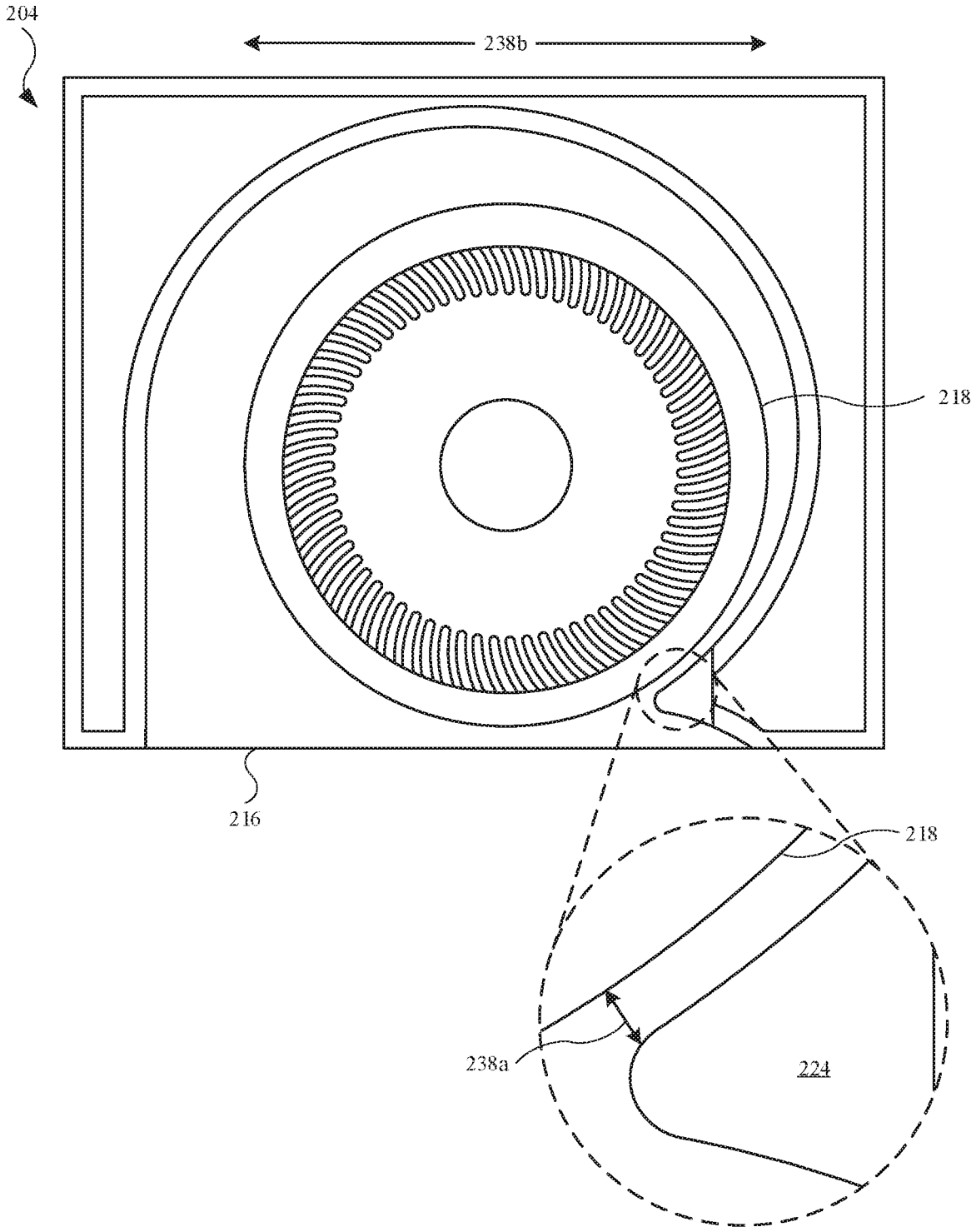
FIG. 4 illustrates a plan view of the fan assembly.

FIG. 4 illustrates a plan view of the fan assembly 204. As shown in the enlarged view, the impeller 218 is separated from the insert 224 by a distance 238*a*, which represents a dimension of the gap, or throat gap, between the impeller 218 and the insert 224. The distance 238*a* may further represent the shortest distance between the impeller 218 and the insert 224, prior to displacement of the insert 224. Also, the impeller 218 may include a diameter 238*b*. The ratio of the distance 238*a* to the diameter 238*b* may be approximately in the range of 1:33 to 1:20. In other words, the design of the fan assembly 204 may be specified such that the distance 238*a* is approximately in the range of 3% to 5% of the diameter 238*b*.

The ratio of the distance 238*a* to the diameter 238*b* can be a contributing factor to noise generation by the fan assembly 204 during operation. For example, when the ratio increases, the gap between the impeller 218 and the insert 224 increases, resulting in reduced pressure and reduced acoustic (tonal) noise. However, the increased gap can also allow additional airflow to recirculate and remain in the fan assembly 204, as compared to smaller gaps. In this regard, the insert 224 provides the fan assembly 204 with a self-adjusting gap that is based upon the airflow and corresponding air pressure applied to the insert 224. For example, the insert 224 responds to increased air pressure by undergoing displacement (such as compression) and providing the fan assembly 204 with an increased gap size during instances of relatively high speed operation (in RPM) by the impeller 218. Conversely, the insert 224 responds to decreased air pressure by returning to its original non-displaced (or decompressed) position and providing a decreased gap during instances of relatively low speed operation of the impeller 218. Accordingly, the gap size is proportional to the speed of the impeller 218.

The self-adjusting features of the gap are provided in part by the material makeup of the insert 224. In this regard, the displacement if the insert 224 may be due solely to the airflow provided by the impeller 218. As a result, the fan assembly 204 may not required external controllers or mechanical levers that actuate the insert 224.

Figure 5:
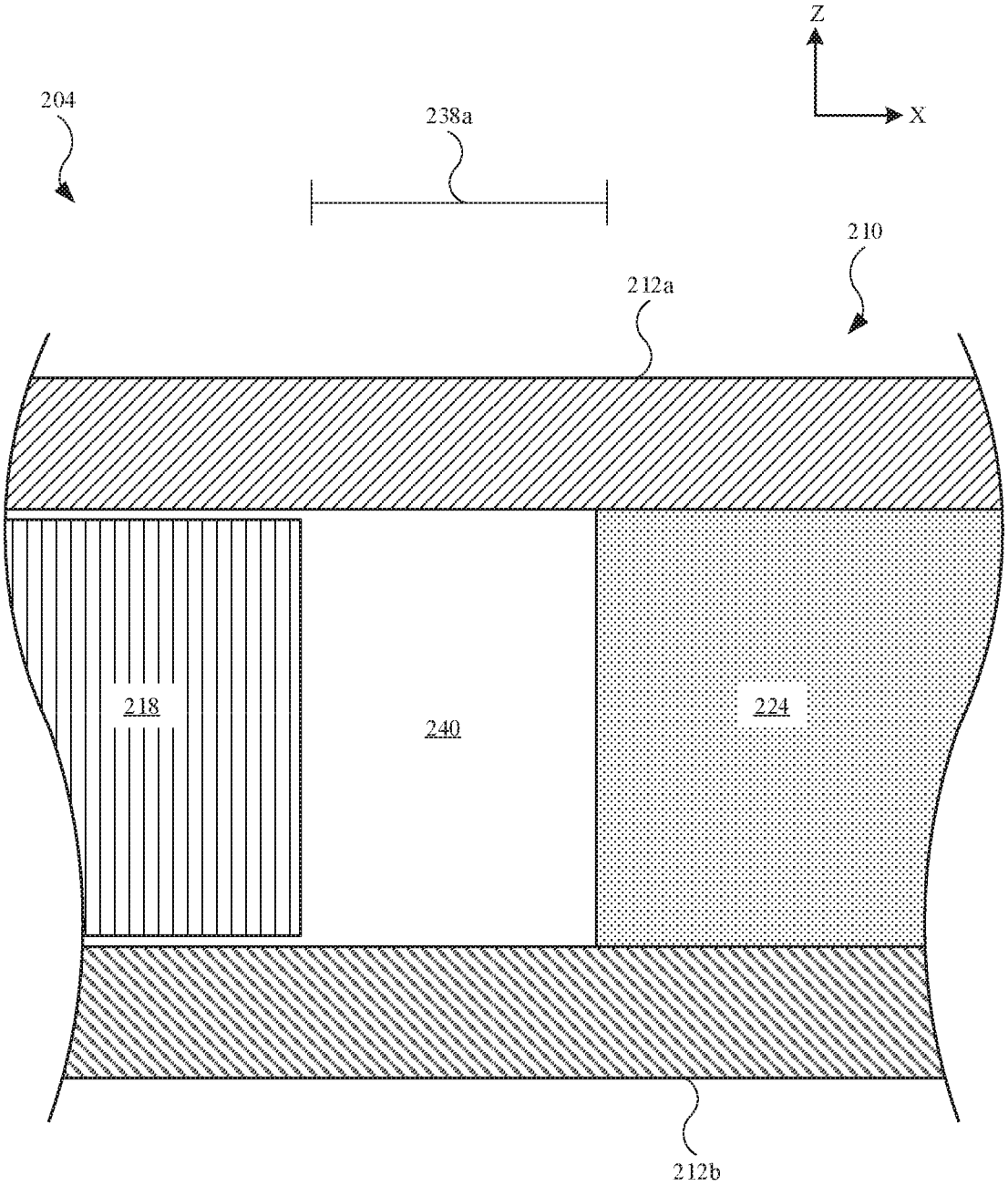
FIG. 5 illustrates a cross sectional view of the fan assembly shown in FIG. 4, showing a gap between the impeller and the insert.

FIG. 5 illustrates a cross sectional view of the fan assembly 204 shown in FIG. 4, showing a gap 240 between the impeller 218 and the insert 224. As shown, the gap 240 is defined in part by the distance 238*a* along the X-axis. The gap 240 (also defined in part by the housing part 212*a*, the housing part 212*b*, the impeller 218 and the insert 224) represents a cross sectional area through which airflow driven by the impeller 218 can pass.

Figure 6:
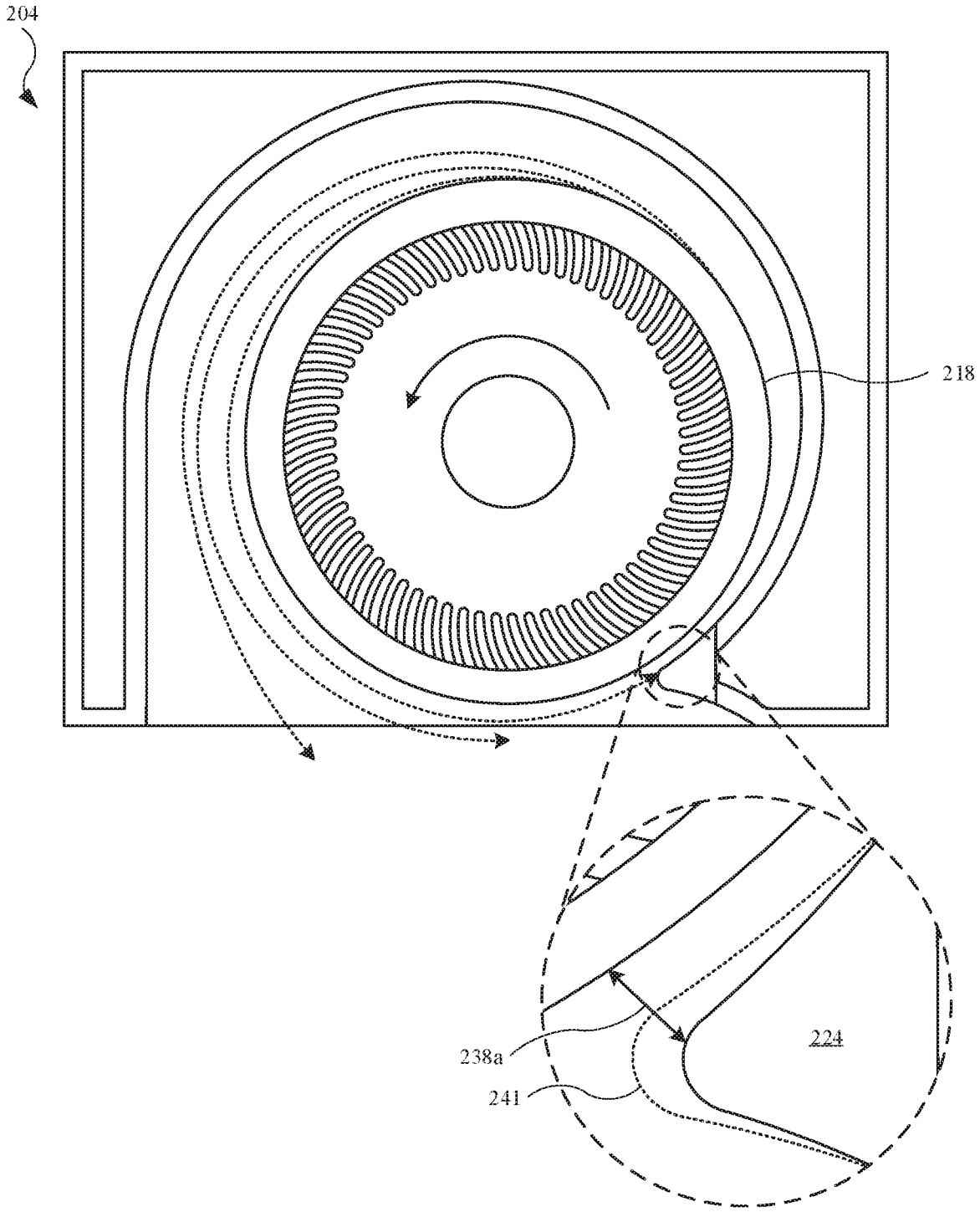
FIG. 6 illustrates a plan view of the fan assembly shown in FIG. 4, showing displacement of the insert in response to airflow generated by the impeller.

The insert 224, as shown in FIGS. 4 and 5, defines a decompressed state in which no airflow or an insufficient amount of airflow is acting upon the insert 224. However, the insert 224 may transition from the decompressed stated to a compressed state. For example, FIG. 6 illustrates a plan view of the fan assembly 204 shown in FIG. 4, showing displacement of the insert 224 in response to airflow generated by the impeller 218. As shown, the impeller 218 is undergoing rotational movement. Further, the speed, in RPM, of the impeller 218 is sufficient to provide a force from the airflow such that the insert 224 is displaced. For example, as shown in the enlarged view, the airflow contacts the insert 224, thereby causing the insert 224 to compress. The dotted line 241 indicates the initial position prior to the airflow displacing the insert 224. The compression of the insert 224 causes the distance 238*a* to increase.

Figure 7:
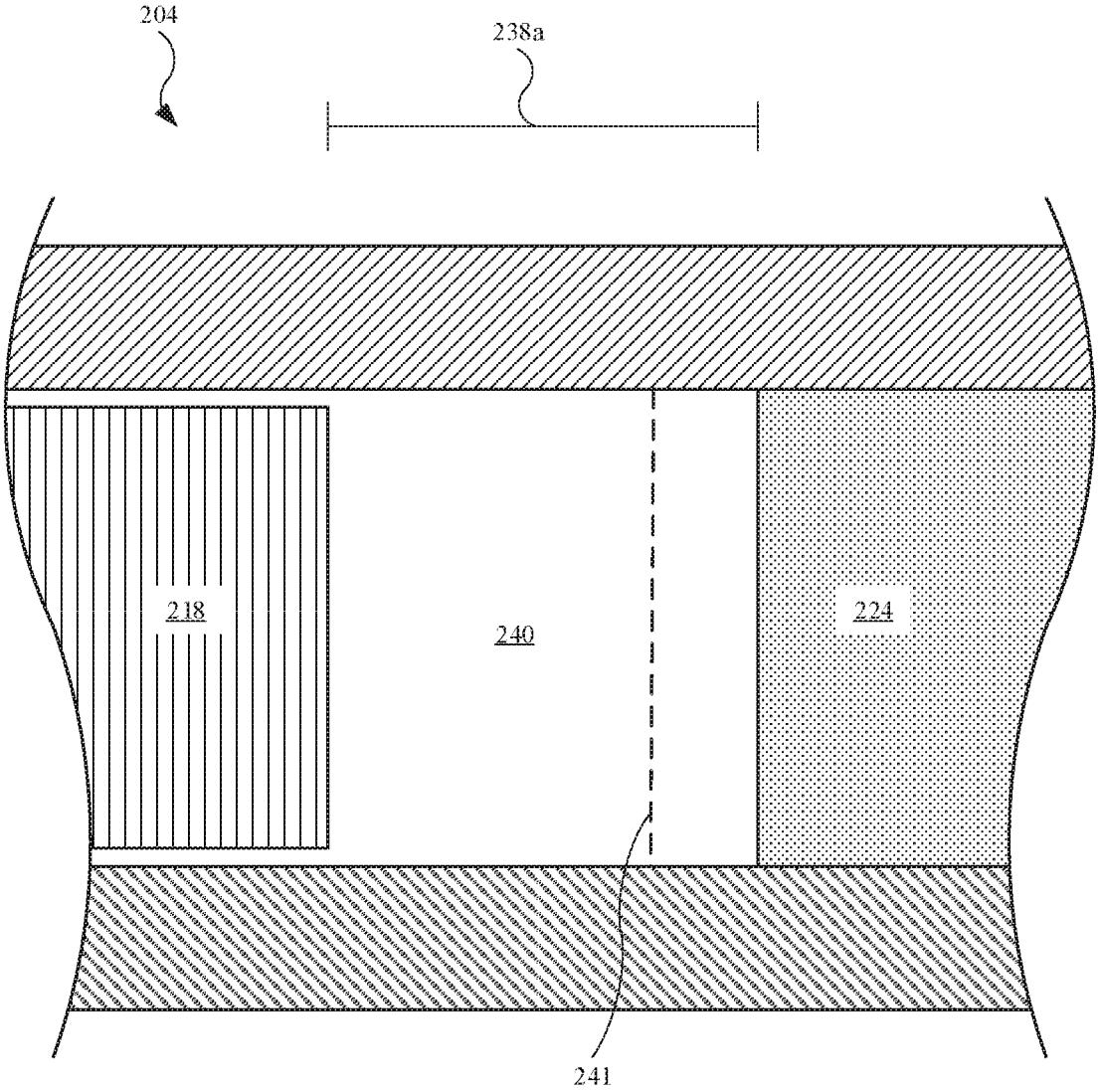
FIG. 7 illustrates a cross sectional view of the fan assembly shown in FIG. 6, showing the gap based on the airflow displacing the insert.

FIG. 7 illustrates a cross sectional view of the fan assembly 204 shown in FIG. 6, showing the gap 240 increased based on the airflow displacing the insert 224. The dotted line 241 indicates the initial position prior to the airflow displacing the insert 224. Based on the increase in the distance 238*a* between the impeller 218 and the insert 224, the cross sectional area of the gap 240 is increased. The increased cross sectional area of the gap 240 results in reduced air pressure (from the airflow) at the gap 240, and subsequently reduced acoustic noise generated by the fan assembly 204.

Figure 8:
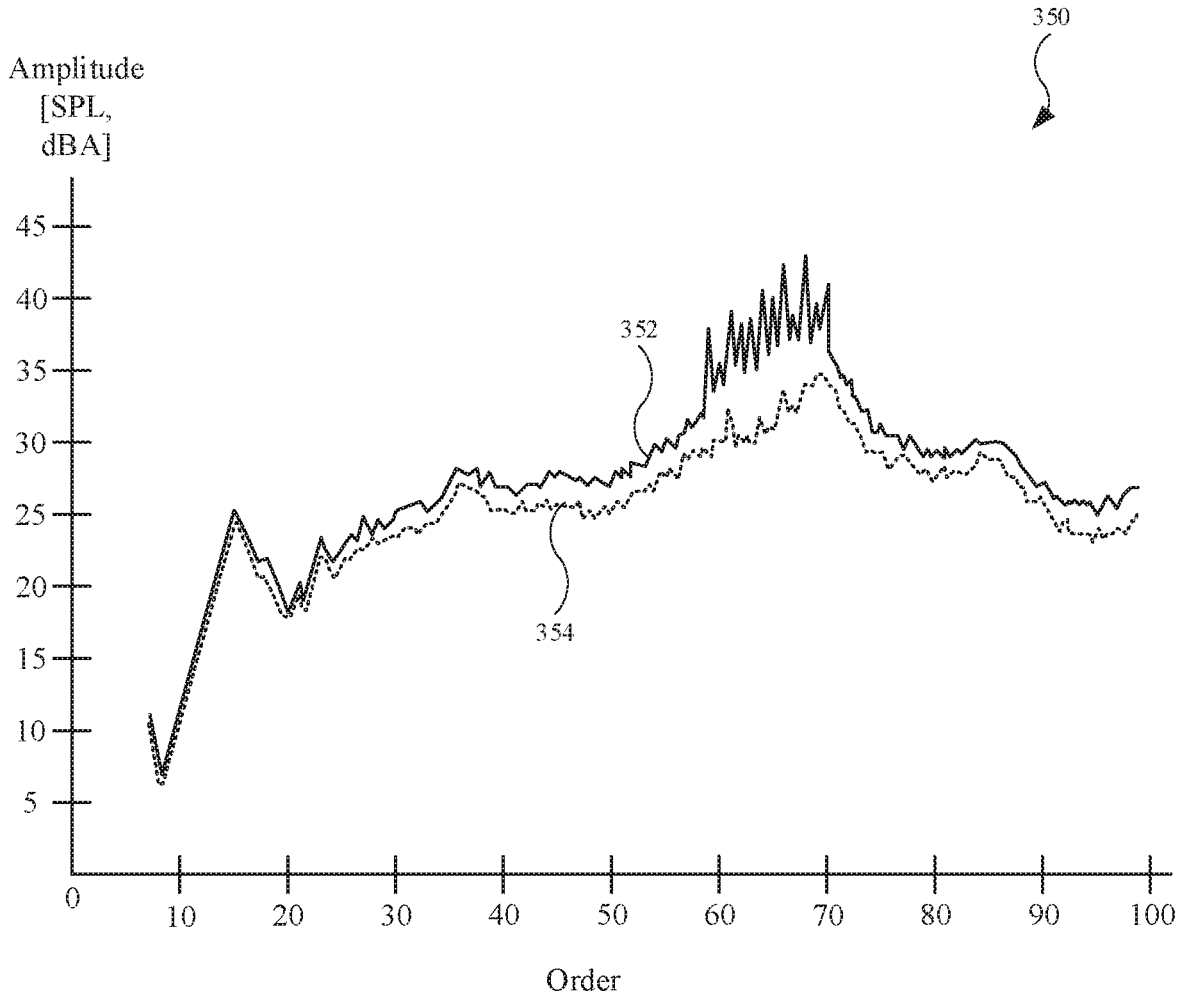
FIG. 8 illustrates a graph plotting amplitude vs. fan order a fan assembly during operation, in accordance with some described embodiments.

FIG. 8 illustrates a graph 350 plotting amplitude vs. fan order for a fan assembly during operation, in accordance with some described embodiments. The (vertical) Y-axis represents the amplitude of the sound pressure level ("SPL"). The fan order on the (horizontal) X-axis represents the number of blades passing a reference point, or blade passing frequency, under a full rotation of an impeller of a fan assembly. The impeller speed, in RPM, is held constant.

The graph 350 illustrates a plot 352 (solid line) representing a fan assembly with a ratio of separation distance (between the impeller and the insert) to impeller diameter of 1:35. The graph 350 further illustrates a plot 354 (dotted line) representing a fan assembly with a ratio of separation distance to impeller diameter of 1:20. As indicated by the plot 352 and the plot 354, the amplitude for the fan order between 10 and 50 is similar. However, when the fan order is in the range of 60 to 70, the amplitude is noticeably different. For instance, the plot 352 shows several spikes indicating an increased tonal component of the fan assembly separate from the broadband noise from the fan assembly. On the other hand, the plot 354 is smoother, indicating reduced tonal components. As shown in the graph 350, the amplitude between the plot 352 and the plot 354 may differ by 10-15 dBa in this range of 60 to 70. As a result, a fan assembly using the ratio of separation distance to impeller diameter of 1:20 may generate less tonal noise as compared to a fan assembly with a ratio of 1:35.

FIGS. 9-17 show and describe additional embodiments of a fan assembly. The fan assemblies shown and described in FIGS. 9-17 may include several, if not all, features previously described for fan assemblies. Further, the fan assemblies shown and described in FIGS. 9-17 can be integrated with the electronic device (shown in FIG. 1).

Figure 9:
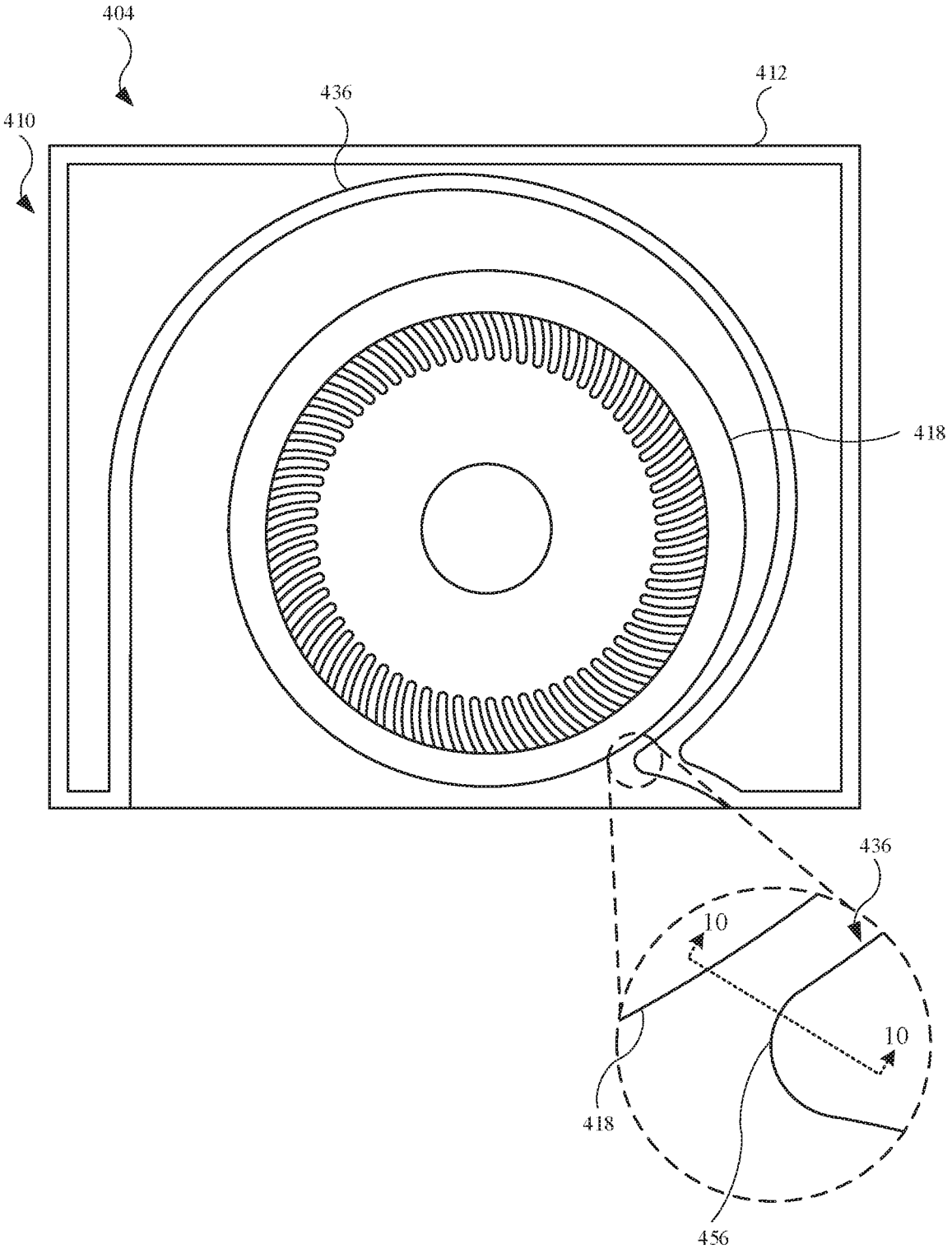
FIG. 9 illustrates a plan view of an alternate embodiment of a fan assembly.

FIG. 9 illustrates a plan view of an alternate embodiment of a fan assembly 404. As shown, the fan assembly 404 includes a fan housing 410 that includes a housing part 412. The housing part 412 includes an internal wall 436. For purposes of illustration, an additional housing part with an internal wall is not shown. The fan assembly 404 further includes an impeller 418 positioned within the perimeter of the internal wall 436. As shown in the enlarged view, the internal wall 436 defines a tip 456 that is separated from the impeller 418. The tip 456 may be integrally formed with the internal wall 436 such that the internal wall 436 and the tip 456 are part of a monolithic structure. However, the tip 456 can nonetheless undergo displacement when the impeller 418 is rotationally driven.

Figure 10:
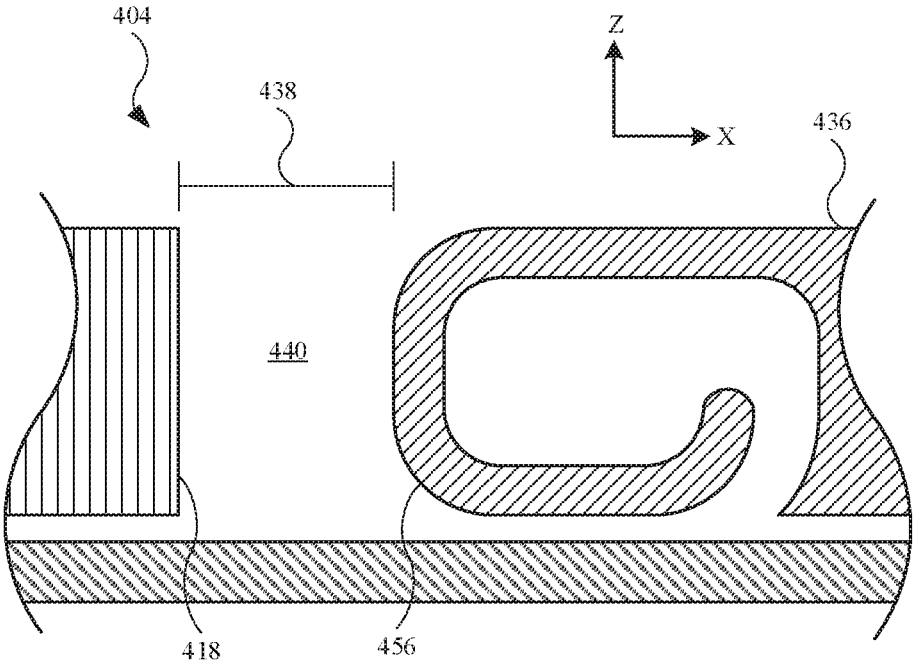
FIG. 10 illustrates a cross sectional view of the fan assembly shown in FIG. 9, showing structural features of the tip.

FIG. 10 illustrates a cross sectional view of the fan assembly 404 shown in FIG. 9, taken along line 10-10, showing structural features of the tip 456. As shown, the tip 456 is separated from the impeller 418 by a distance 438. Also, a gap 440 is defined in part by the distance 438 along the X-axis. Further, the tip 456 is connected to the internal wall 436 in a cantilevered manner such that the tip 456 can bend or flex relative to the internal by, for example, airflow generated from the impeller 418.

Figure 11:
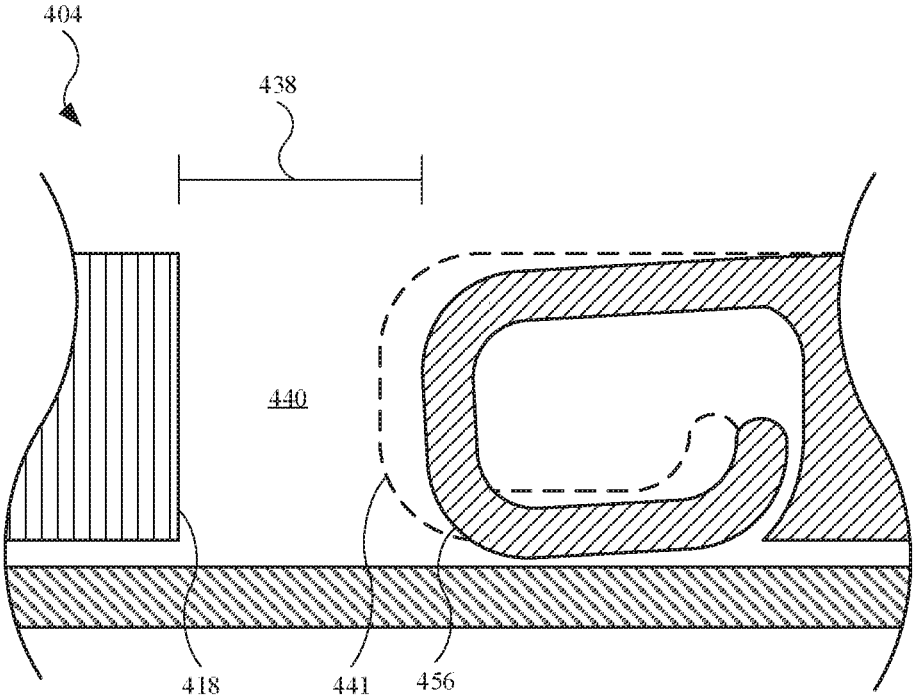
FIG. 11 illustrates a cross sectional view of the fan assembly shown in FIG. 10, showing displacement of the tip in response to the airflow.

FIG. 11 illustrates a cross sectional view of the fan assembly 404 shown in FIG. 10, showing displacement of the tip 456 in response to the airflow. As shown, the distance 438 between the impeller 418 and the tip 456 increases based on the airflow displacing the tip 456. The dotted line 441 indicates the initial position prior to the airflow displacing the tip 456. Based on the increase in the distance 438 between the impeller 418 and the tip 456, the cross sectional area of the gap 440 also increases. The increased cross sectional area of the gap 440 results in reduced air pressure (due the airflow) at the gap 440, and subsequently reduced acoustic noise generated by the fan assembly 404.

Figure 12:
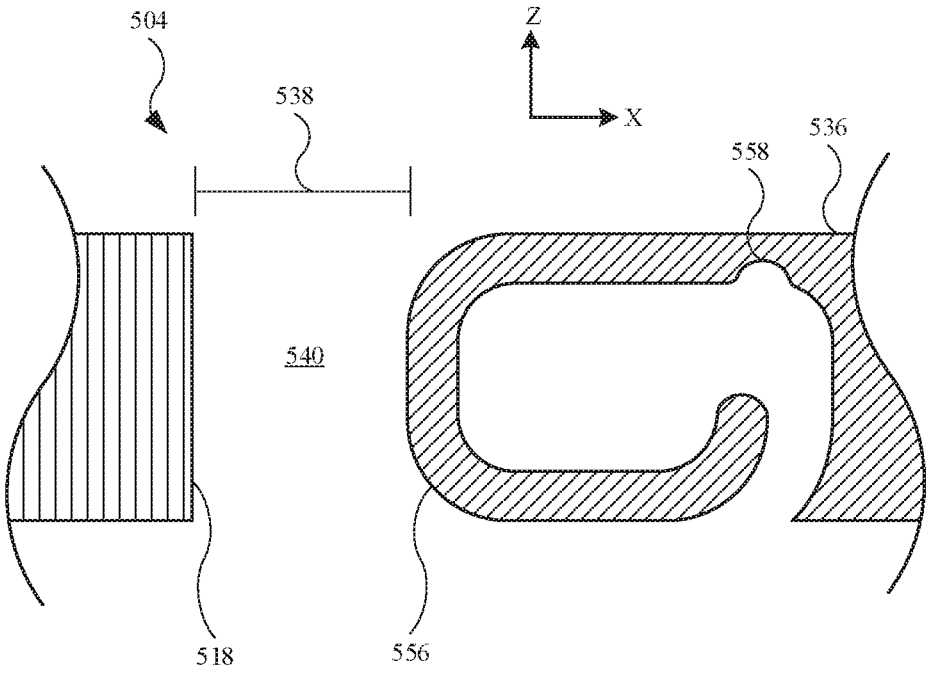
FIG. 12 illustrates a cross sectional view of an alternate embodiment of a fan assembly, showing the fan assembly with a tip modified with a recess.

In some instances, the displacement of the tip can be altered by modifying/adjusting the tip. For example, FIG. 12 illustrates a cross sectional view of an alternate embodiment of a fan assembly 504, showing the fan assembly 504 with a tip 556 modified with a recess 558. As shown, the tip 556 is separated from the impeller 518 by a distance 538. Also, a gap 540 is defined in part by the distance 538 along the X-axis. The tip 556 is connected to an internal wall 536 of the fan assembly 504 in a cantilevered manner such that the tip 556 can bend or flex relative to the internal by, for example, airflow generated from an impeller 518. However, the recess 558 is formed at the connection point between the tip 556 and the internal wall 536, thereby allowing the tip 556 to bend or flex under a lower force from the airflow.

Figure 13:
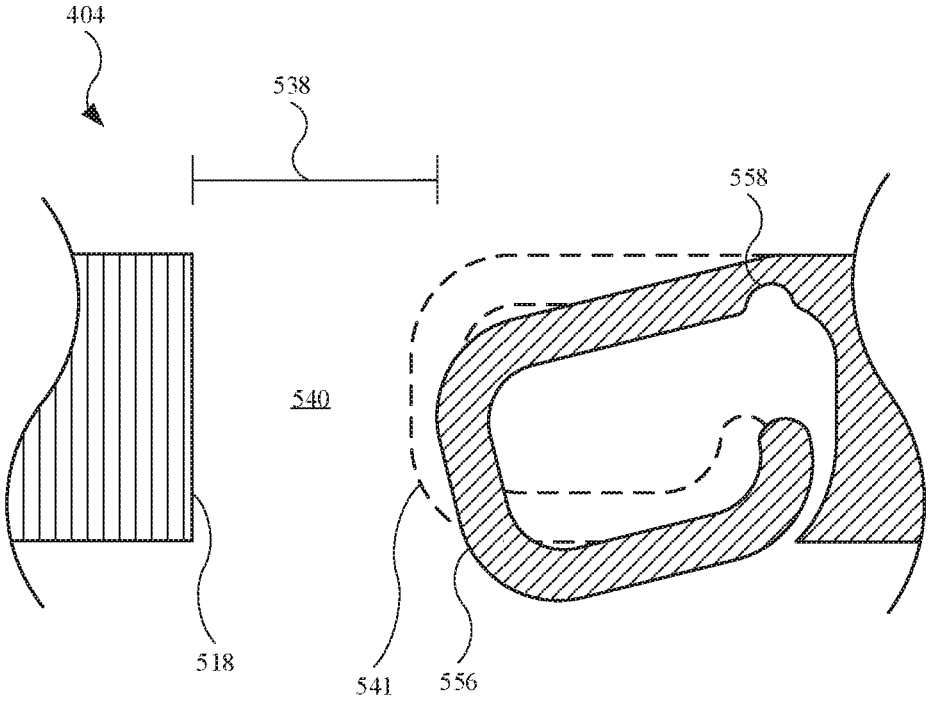
FIG. 13 illustrates a cross sectional view of the fan assembly shown in FIG. 12, showing displacement of the tip in response to airflow.

FIG. 13 illustrates a cross sectional view of the fan assembly shown in FIG. 12, showing displacement of the tip 556 in response to airflow. As shown, the distance 538 between the impeller 518 and the tip 556 increases based on the airflow displacing the tip 556. The dotted line 541 indicates the initial position prior to the airflow displacing the tip 556. The recess 558 can provide the tip 556 with a more responsive movement by requiring less airflow. In other words, based upon the recess 558, the tip 556 may react more quickly and/or react using less airflow. Similar to prior embodiments, the cross sectional area of the gap 540 increases as a result of the displacement of the tip 556, which may lead to reduced acoustic noise generated by the fan assembly 504.

Figure 14:
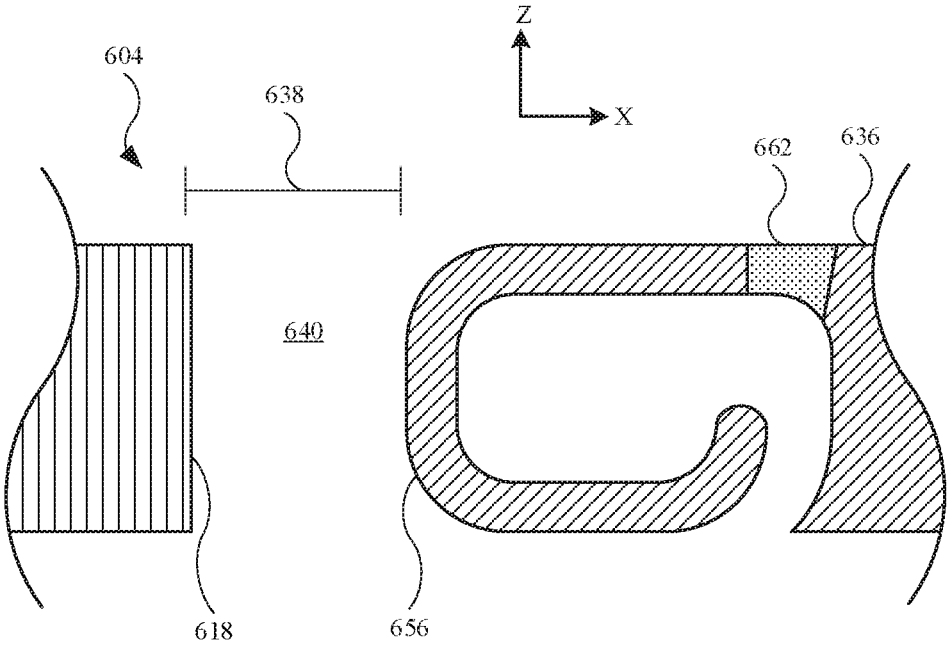
FIG. 14 illustrates a cross sectional view of an alternate embodiment of a fan assembly, showing the fan assembly with an insert modified with a flexible material.

FIG. 14 illustrates a cross sectional view of an alternate embodiment of a fan assembly 604, showing the fan assembly 604 with a tip 656 modified with a flexible material 662. As shown, the tip 656 is separated from the impeller 618 by a distance 638. Also, a gap 640 is defined in part by the distance 638 along the X-axis. The tip 656 is connected to an internal wall 636 of the fan assembly 604 by the flexible material 662. The flexible material 662 may include a relatively less rigid material, as compared to the material that forms the internal wall 636 and the tip 656. For example, the internal wall 636 and the tip 656 may include a rigid plastic, while the flexible material 662 includes foam, an elastomeric material, or a flexible adhesive, as non-limiting examples. The flexible material 662 defines the connection point between the tip 656 and the internal wall 636. In this manner, the tip 556 may bend or flex under a lower force from the airflow based upon the spring constant of the flexible material 662 rather than the material of the internal wall 636.

Figure 15:
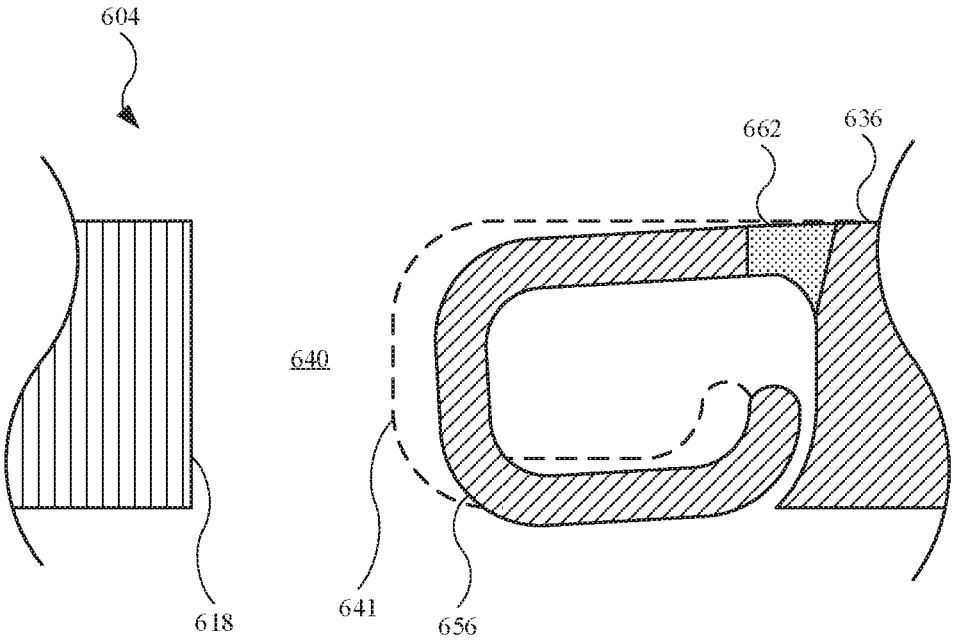
FIG. 15 illustrates a cross sectional view of the fan assembly shown in FIG. 14, showing displacement of the tip in response to airflow.

FIG. 15 illustrates a cross sectional view of the fan assembly shown in FIG. 14, showing displacement of the tip 656 in response to airflow. As shown, the distance 638 between the impeller 618 and the tip 656 increases based on the airflow displacing the tip 656. The dotted line 641 indicates the initial position prior to the airflow displacing the tip 656. By lower the spring constant required to displace the tip 656, the flexible material 662 can provide the tip 556 with a more responsive movement and/or allow displacement of the tip 656 using less airflow. Similar to prior embodiments, the cross sectional area of the gap 640 increases as a result of the displacement of the tip 656, which may lead to reduced acoustic noise generated by the fan assembly 604.

Figure 16:
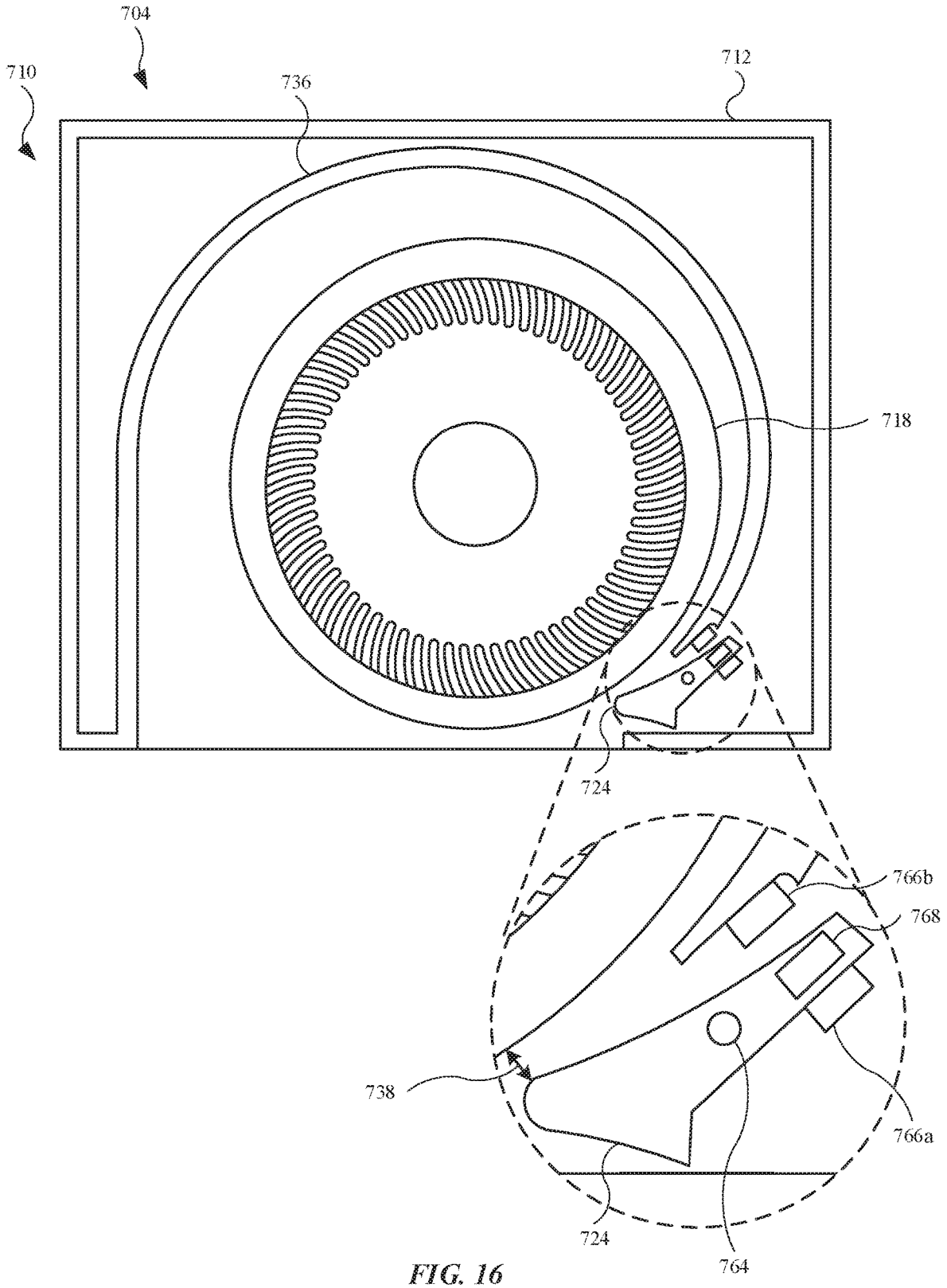
FIG. 16 illustrates a cross sectional view of an alternate embodiment of a fan assembly, showing the fan assembly with an insert controlled by magnets.

FIG. 16 illustrates a cross sectional view of an alternate embodiment of a fan assembly 704, showing the fan assembly 704 with an insert 724 controlled by magnets. As shown, the fan assembly 704 includes a fan housing 710 that includes a housing part 712. The housing part 712 includes an internal wall 736. For purposes of illustration, an additional housing part with an internal wall is not shown. The fan assembly 704 further includes an impeller 718 positioned within the perimeter of the internal wall 736. The fan assembly 704 may include an insert 724 located in the fan housing 710. The insert 724 may include a rigid material, such as metal or plastic. However, other materials described herein for an insert may be used. As shown in the enlarged view, the insert 724 is coupled to the fan housing 710 by a pivot 764. In this regard, the insert 724 can rotate about the pivot 764.

Further, the insert 724 may include a bi-stable configuration in which one configuration includes no airflow or relatively low airflow generated by the impeller 718, and another configuration in which a relatively high airflow is generated by the impeller 718. In this regard, the fan assembly 704 includes a magnet **766*a* and a magnet 766*b* carried by the fan housing 710, as well as a magnet 768 carried by the insert 724. As shown, the magnet 768 (of the insert 724) is magnetically coupled with the magnet 766*a* (in the fan housing 710), and the insert 724 is separated from the impeller 718 by a distance 738. The distance 738 represents the closest distance between the impeller 718 and the insert 724. The position of the insert 724 shown in FIG. 16 represents an inactive state of the impeller 718. Alternatively, the position of the insert 724 shown in FIG. 16 represents low airflow generated by the impeller 718 that does not generate sufficient force to overcome the magnetic attraction force between the magnet 766*a* and the magnet 768**.

Figure 17:
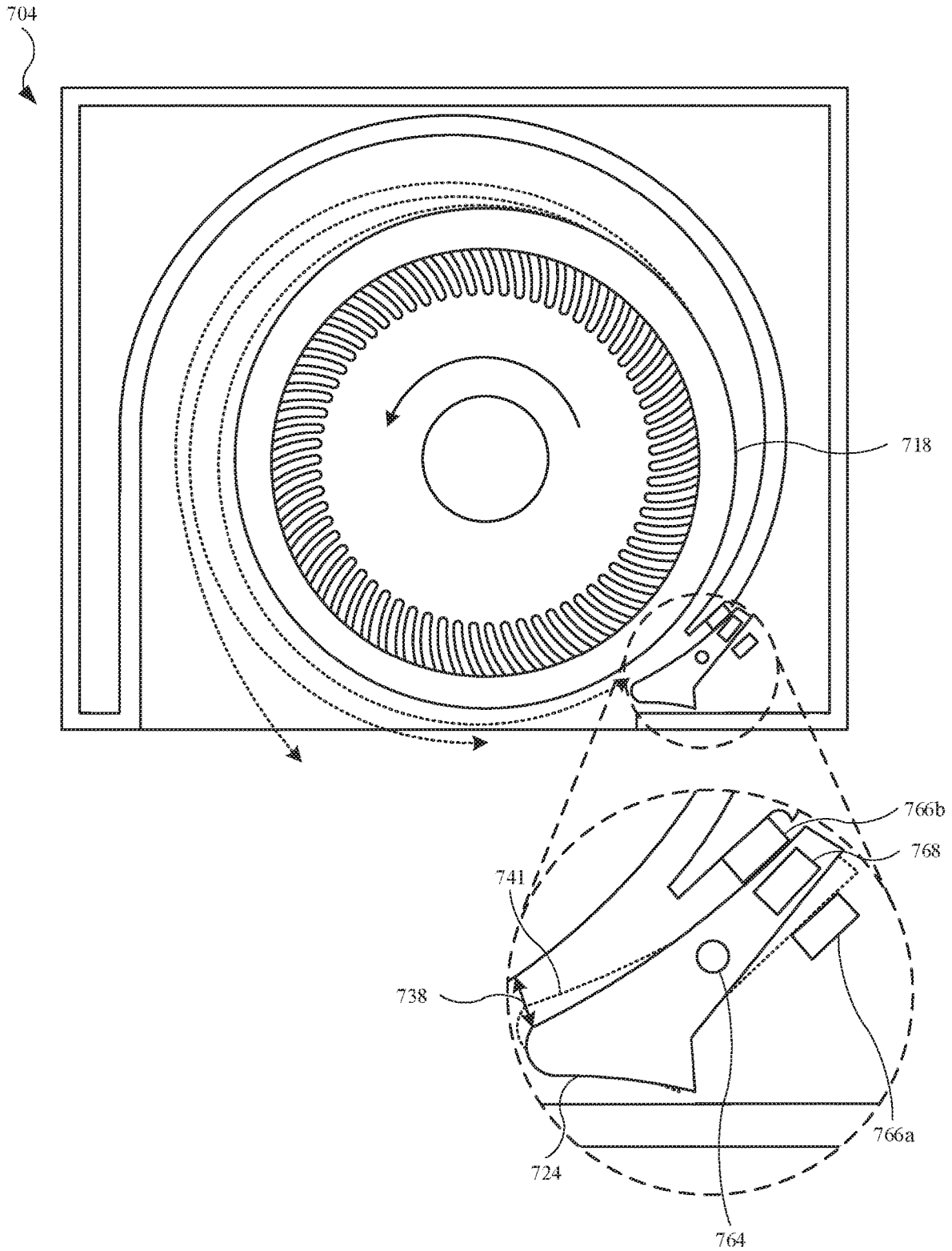
FIG. 17 illustrates a cross sectional view of the fan assembly shown in FIG. 16, showing the displacement of the insert in response to airflow.

FIG. 17 illustrates a cross sectional view of the fan assembly 704 shown in FIG. 16, showing the displacement of the insert 724 in response to airflow. As shown, the impeller 718 is undergoing rotational movement. Further, the speed, in RPM, of the impeller 718 creates sufficient airflow such that the insert 724 is displaced. As shown in the enlarged view, the force generated by the airflow overcomes the magnetic attraction force between the magnet **766*a* and the magnet 768, and causes the insert 724 to rotate counter-clockwise about the pivot 764 such that the magnet 768 magnetically couples with the magnet 766*b*. The rotation of the insert 724 to the position shown in FIG. 17 causes the distance 738 to increase, thereby increasing the cross sectional area of the gap between the impeller 718 and the insert 724. The dotted line 741 indicates the initial position prior to the airflow displacing the insert 224. In this manner, the gap between the impeller 718 and the insert 724 increases as a result of the displacement of the tip 656, which may lead to reduced acoustic noise generated by the fan assembly 704. It should be noted that when the airflow by the impeller 718 sufficiently reduces or stops, the pivot 764 may provide biasing force to the insert 724 that overcomes the magnetic attraction force between the magnet 766*b* and the magnet 768, and causes the insert 724 to rotate clockwise about the pivot 764 such that the magnet 768 magnetically couples with the magnet 766*a***.

Figure 18:
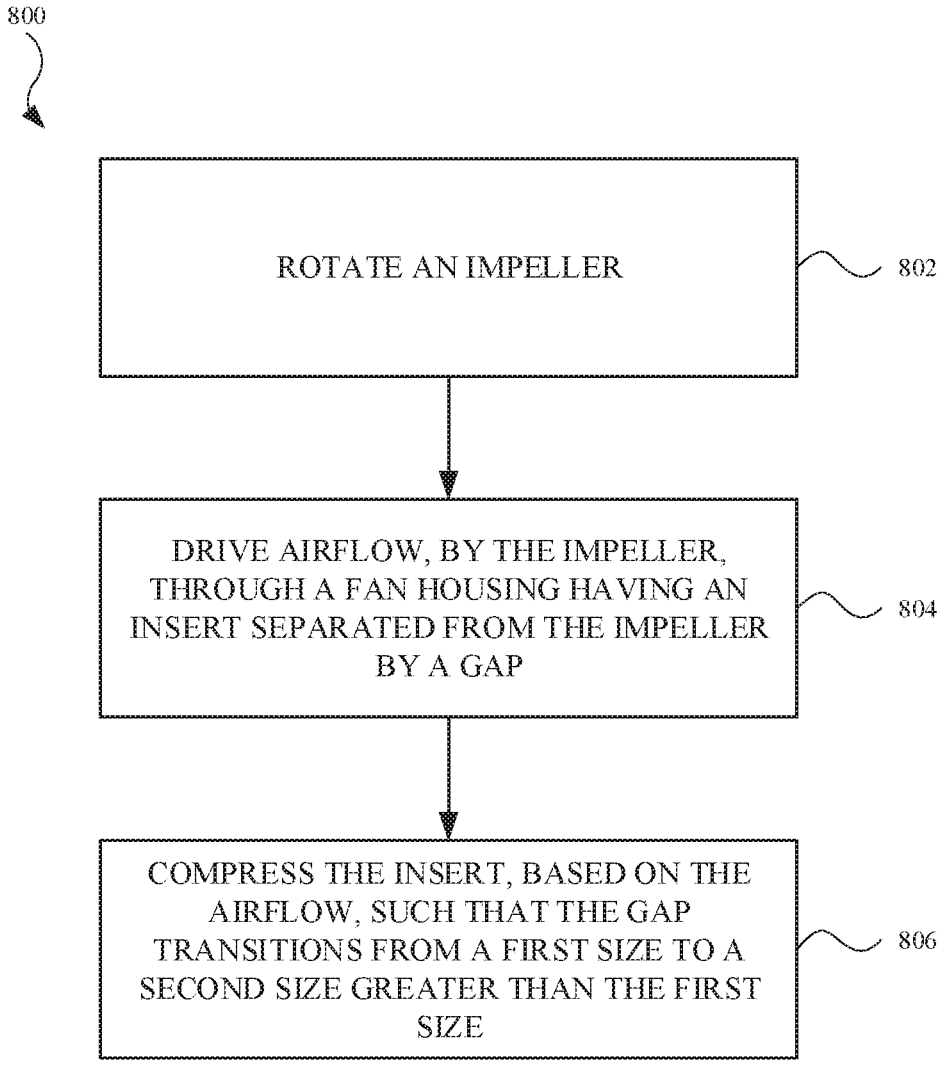
FIG. 18 illustrates a flowchart showing a method for operating a fan assembly in an electronic device, in accordance with some described embodiments.

FIG. 18 illustrates a flowchart 800 showing a method for operating a fan assembly in an electronic device, in accordance with some described embodiments. One or more of the fan assemblies (previously described) may carry out the method shown in the flowchart 800. In step 802, an impeller of the fan assembly is rotated. The impeller may include several blades. Also, the fan assembly may include a motor that rotationally drives the impeller.

In step 804, the impeller drives airflow through a fan housing. The fan housing carries an insert that is separated from the impeller by a gap. The gap may define a space with a cross sectional area between the impeller and the insert.

In step 806, the insert is compressed, based on the airflow. In this regard, the insert is compressed such that the gap transitions from a first size to a second size greater than the first size. The second size refers to a gap size that is greater than that of the first size. As a result of the second gap size, the cross sectional area between the impeller and the insert is greater, resulting in less air pressure and noise generation during operation of the fan assembly.

Figure 19:
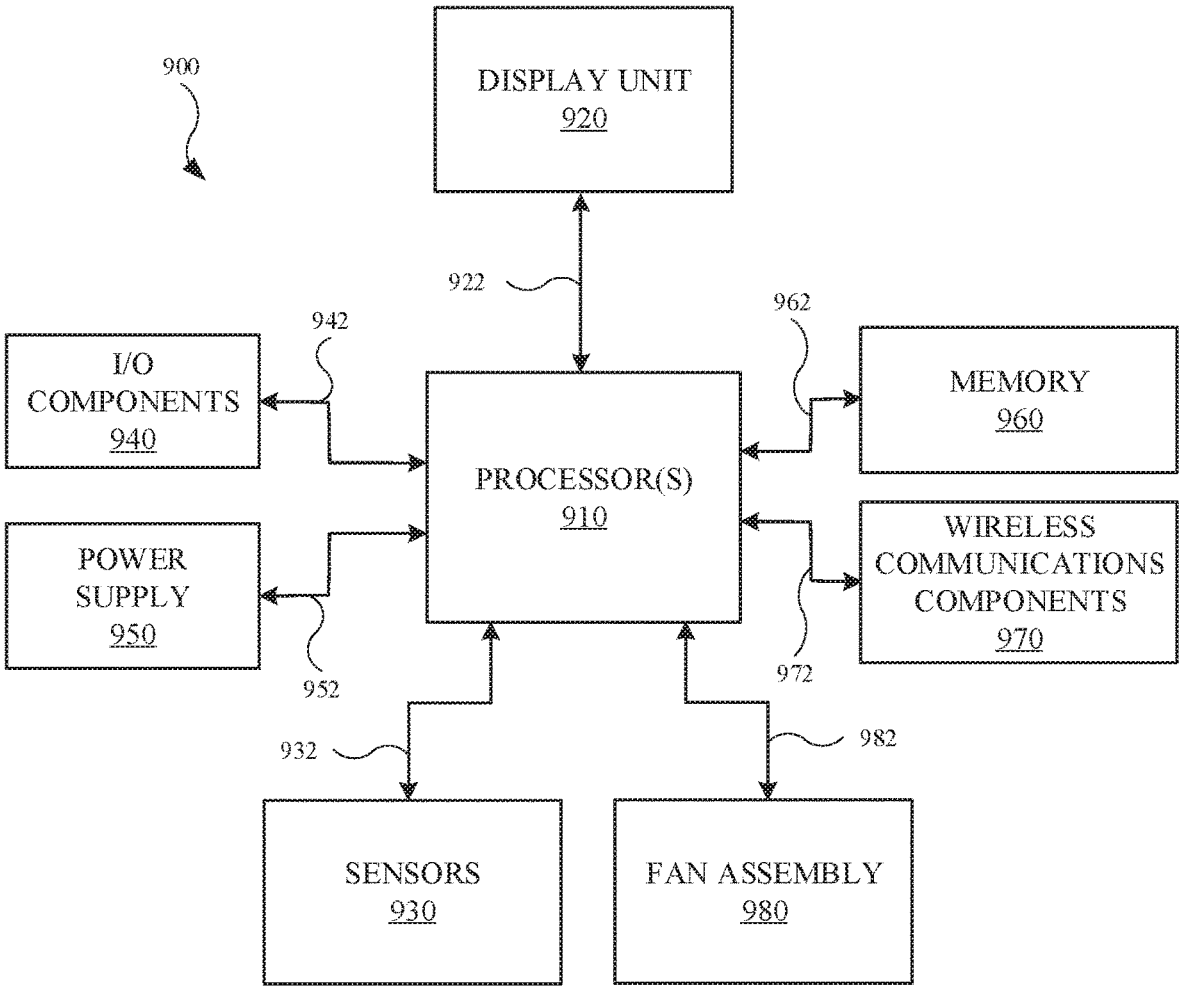
FIG. 19 illustrates a block diagram of an electronic device, in accordance with some described embodiments.

FIG. 19 illustrates a block diagram of an electronic device, in accordance with some described embodiments. The features in the electronic device 900 may be present in other electronic devices described herein. The electronic device 900 may include one or more processors 910 for executing functions of the electronic device 900. The one or more processors 910 can refer to at least one of a central processing unit (CPU) and at least one microcontroller for performing dedicated functions. Also, the one or more processors 910 can refer to application specific integrated circuits.

According to some embodiments, the electronic device 900 can optionally include a display unit 920. The display unit 920 is capable of presenting a user interface that includes icons (representing software applications), textual images, and/or motion images. In some examples, each icon can be associated with a respective function that can be executed by the one or more processors 910. In some cases, the display unit 920 includes a display layer (not illustrated), which can include a liquid-crystal display (LCD), light-emitting diode display (LED), or the like. According to some embodiments, the display unit 920 includes a touch input detection component and/or a force detection component that can be configured to detect changes in an electrical parameter (e.g., electrical capacitance value) when the user's appendage (acting as a capacitor) comes into proximity with the display unit 920 (or in contact with a transparent layer that covers the display unit 920). The display unit 920 is connected to the one or more processors 910 via one or more connection cables 922.

According to some embodiments, the electronic device 900 can include one or more sensors 930 capable of provide an input to the one or more processors 910 of the electronic device 900. The one or more sensors 930 may include a temperature sensor, as a non-limiting example. The one or more sensors 930 is/are connected to the one or more processors 910 via one or more connection cables 932.

According to some embodiments, the electronic device 900 can include one or more input/output components 940. In some cases, the one or more input/output components 940 can refer to a button or a switch that is capable of actuation by the user. When the one or more input/output components 940 are used, the one or more input/output components 940 can generate an electrical signal that is provided to the one or more processors 910 via one or more connection cables 942.

According to some embodiments, the electronic device 900 can include a power supply 950 that is capable of providing energy to the operational components of the electronic device 900. In some examples, the power supply 950 can refer to a rechargeable battery. The power supply 950 can be connected to the one or more processors 910 via one or more connection cables 952. The power supply 950 can be directly connected to other devices of the electronic device 900, such as the one or more input/output components 940. In some examples, the electronic device 900 can receive power from another power sources (e.g., an external charging device) not shown in FIG. 19.

According to some embodiments, the electronic device 900 can include memory 960, which can include a single disk or multiple disks (e.g., hard drives), and includes a storage management module that manages one or more partitions within the memory 960. In some cases, the memory 960 can include flash memory, semiconductor (solid state) memory or the like. The memory 960 can also include a Random Access Memory ("RAM") and a Read-Only Memory ("ROM"). The ROM can store programs, utilities or processes to be executed in a non-volatile manner. The RAM can provide volatile data storage, and stores instructions related to the operation of the electronic device 900. In some embodiments, the memory 960 refers to a non-transitory computer readable medium. The one or more processors 910 can also be used to execute software applications. In some embodiments, a data bus 962 can facilitate data transfer between the memory 960 and the one or more processors 910.

According to some embodiments, the electronic device 900 can include wireless communications components 970. A network/bus interface 972 can couple the wireless communications components 970 to the one or more processors 910. The wireless communications components 970 can communicate with other electronic devices via any number of wireless communication protocols, including at least one of a global network (e.g., the Internet), a wide area network, a local area network, a wireless personal area network (WPAN), or the like. In some examples, the wireless communications components 970 can communicate using NFC protocol, BLUETOOTH® protocol, or WIFI® protocol.

According to some embodiments, the electronic device 900 can include a fan assembly 980. The fan assembly 980 is designed to remove heat from one or more heat-generating components of the electronic device 900, such as the one or more processors 910. The fan assembly 980 may include modifications such as an insert designed to reduce air pressure and noise generation by the fan assembly 980 by promoting a self-adjusting gap between the insert and an impeller of the fan assembly 980. In some embodiments, one or more cables 982 can facilitate signals between the fan assembly 980 and the one or more processors 910. As a result, the one or more processors 910 may use information from the sensors 930 to control the fan assembly 980.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. An electronic device, comprising:

an enclosure that defines an internal volume; and a fan assembly located in the internal volume, the fan assembly comprising:

a fan housing, an impeller positioned in the fan housing, and an insert positioned in the fan housing and separated from the impeller by a gap, wherein airflow by the impeller into the gap causes displacement of the insert such that the insert changes from a first size to a second size that is less than the first size.

2. The electronic device of claim 1, wherein the gap comprises a self-adjusting gap based upon compression of the insert, wherein the compression of the insert is based upon a rotational speed of the impeller.

3. The electronic device of claim 1, wherein the insert comprises an elastomeric insert.

4. The electronic device of claim 3, wherein the elastomeric insert comprises a spring force, and wherein the airflow provides a force that is greater than the spring force.

5. The electronic device of claim 1, wherein rotational movement of the impeller drives the airflow that causes the insert to transition to the second size, and wherein the insert is configured to transition to the first size when the rotational movement ceases.

6. The electronic device of claim 1, wherein the insert comprises foam.

7. The electronic device of claim 1, wherein the first size comprises a first cross sectional area, and wherein the second size comprises a second cross sectional area less than the first cross sectional area.

8. An electronic device, comprising:

an enclosure that defines an internal volume; and a fan assembly located in the internal volume, the fan assembly comprising:

a fan housing, an impeller located in the fan housing, and an insert located in the fan housing, wherein:

a decompressed state of the insert comprises a separation between the insert and the impeller by a gap having a first dimension, and a compressed state of the insert comprises the separation between the insert and the impeller increasing to a second dimension of the gap that is greater than the first dimension.

9. The electronic device of claim 8, wherein the gap comprises a self-adjusting gap that transitions from a first size in the decompressed state to a second size in the compressed state based upon airflow generated by the impeller, and the first size is greater than the second size.

10. The electronic device of claim 9, wherein the insert is configured to transition from the compressed state to the decompressed state when the airflow ceases.

11. The electronic device of claim 9, wherein the insert comprises an elastomeric insert.

12. The electronic device of claim 11, wherein the elastomeric insert comprises a spring force, and wherein the airflow provides a force that is greater than the spring force.

13. The electronic device of claim 8, wherein the insert comprises foam.

14. The electronic device of claim 8, wherein rotational movement of the impeller generates airflow that causes the insert to transition to the compressed state, and wherein the insert is configured to transition to the decompressed state when the rotational movement ceases.

15. A method for operating a fan assembly in an electronic device, the method comprising:

by the fan assembly:

rotating an impeller;

driving airflow, by the impeller, through a fan housing having an insert separated from the impeller by a gap; and compressing the insert, based on the airflow, such that the insert transitions from a first size to a second size less than the first size.

16. The method of claim 15, wherein the gap comprises a self-adjusting based upon compressing the insert.

17. The method of claim 15, further comprising decompressing the insert when the impeller ceases rotation.

18. The method of claim 15, wherein compressing the insert comprises compressing a foam insert.

19. The method of claim 15, wherein compressing the insert comprises compressing an elastomeric insert.

20. The method of claim 19, wherein compressing the elastomeric insert comprises providing a force that overcomes a spring force of the elastomeric insert.

* * * * *